US010407910B2

(12) United States Patent
Janczura et al.

(10) Patent No.: US 10,407,910 B2
(45) Date of Patent: Sep. 10, 2019

(54) SUPPORTING BEAM FOR SLAB SYSTEMS, SLAB SYSTEM AND METHOD FOR THE PRODUCTION THEREOF

(71) Applicant: Pfeifer Holding GmbH & Co. KG, Memmingen (DE)

(72) Inventors: Krzysztof Janczura, Wroclaw (PL); Jerzy Derysz, Warsaw (PL)

( * ) Notice: Subject to any disclaimer, the term of this patent is extended or adjusted under 35 U.S.C. 154(b) by 0 days.

(21) Appl. No.: 15/756,492

(22) PCT Filed: Aug. 31, 2016

(86) PCT No.: PCT/EP2016/070498
§ 371 (c)(1),
(2) Date: Feb. 28, 2018

(87) PCT Pub. No.: WO2017/037106
PCT Pub. Date: Mar. 9, 2017

(65) Prior Publication Data

US 2018/0291626 A1 Oct. 11, 2018

(30) Foreign Application Priority Data

Sep. 1, 2015 (DE) ..... 20 2015 104 628

(51) Int. Cl.
*E04B 1/00* (2006.01)
*E04C 3/293* (2006.01)
(Continued)

(52) U.S. Cl.
CPC ..... *E04C 3/293* (2013.01); *E04B 5/29* (2013.01); *E04B 9/06* (2013.01); *E04C 5/0618* (2013.01)

(58) Field of Classification Search
CPC ..... E04C 3/293; E04C 5/0618; E04B 9/06
(Continued)

(56) References Cited

U.S. PATENT DOCUMENTS 2,015,744 A * 10/1935 Davis ..... E04C 2/043 29/453
2,222,037 A * 11/1940 Lafferty ..... E04B 1/14 52/125.6
(Continued)

FOREIGN PATENT DOCUMENTS

CN 103061443 A 4/2013
CN 103388376 A 11/2013
(Continued)

OTHER PUBLICATIONS

International Search Report and Written Opinion for International Application No. PCT/EP2016/070498, dated Nov. 16, 2016.
(Continued)

*Primary Examiner* — Basil S Katcheves
(74) *Attorney, Agent, or Firm* — Wolf, Greenfield & Sacks, P.C.

(57) ABSTRACT

The invention relates to a supporting beam of composite structure for ceiling systems which are also of a composite structure and which are made at least in sections of concrete, said supporting beam comprising a support, in particular a steel support, which has a base plate and at least one, preferably two webs which, for this purpose, are arranged at an angle, preferably in a perpendicular manner. The invention is characterized in that a space, which is delimited by the web(s) and the base plate, is filled at least in sections with concrete.

25 Claims, 8 Drawing Sheets

(51) Int. Cl.
*E04B 5/29* (2006.01)
*E04C 5/06* (2006.01)
*E04B 9/06* (2006.01)

(58) Field of Classification Search
USPC ..... 52/250
See application file for complete search history.

(56) References Cited

U.S. PATENT DOCUMENTS

| | | | | | |
|---|---|---|---|---|---|
| 3,540,116 | A * | 11/1970 | Bohnsack | E04C 2/28 | 156/563 |
| 3,810,337 | A * | 5/1974 | Pollard | B21D 47/04 | 52/223.8 |
| 3,865,914 | A * | 2/1975 | Nahr | B29D 12/00 | 264/229 |
| 4,580,380 | A * | 4/1986 | Ballard | E04C 3/29 | 52/309.9 |
| 6,519,911 | B1 * | 2/2003 | Sawada | E04C 3/07 | 52/309.9 |
| 6,922,969 | B1 * | 8/2005 | Mina | E04C 2/22 | 52/309.16 |
| 7,814,719 | B2 * | 10/2010 | Cretti | E04B 5/19 | 52/319 |
| 2004/0182027 | A1 * | 9/2004 | Bonacci | E04B 5/29 | 52/319 |
| 2006/0137115 | A1 * | 6/2006 | Park | E01D 2/02 | 14/74.5 |
| 2012/0079782 | A1 * | 4/2012 | Kim | E04B 5/263 | 52/220.1 |
| 2013/0283721 | A1 * | 10/2013 | Ahn | E04B 1/24 | 52/649.6 |
| 2018/0002925 | A1 * | 1/2018 | Kwon | E04B 5/40 | |

FOREIGN PATENT DOCUMENTS

| | | | |
|---|---|---|---|
| CN | 203440994 | U | 2/2014 |
| CN | 103835435 | A | 6/2014 |
| CN | 203669205 | U | 6/2014 |
| CN | 104060761 | A | 9/2014 |
| CN | 104264899 | A | 1/2015 |
| DE | 3204890 | A1 | 8/1983 |
| EP | 0 292 449 | B1 | 7/1991 |
| EP | 0 467 912 | B1 | 6/1994 |
| EP | 1 416 101 | A1 | 5/2004 |
| EP | 1 669 505 | A1 | 6/2006 |
| EP | 1 862 606 | A1 | 12/2007 |
| KR | 10-2012-0028765 | A | 3/2012 |
| WO | WO 90/04690 | A1 | 5/1990 |
| WO | WO 90/12173 | A1 | 10/1990 |
| WO | WO 2007/131115 | A1 | 11/2007 |
| WO | WO 2011/012974 | A2 | 2/2011 |

OTHER PUBLICATIONS

International Preliminary Report on Patentability for International Application No. PCT/EP2016/070498, dated Mar. 15, 2018.
Search Report for German Application No. 20 2015 104 628.6, dated Jun. 7, 2016.
Search Report for Singaporean Application No. 11201801645U, dated May 3, 2019.
Written Opinion for Singaporean Application No. 11201801645U, dated May 6, 2019.
First Office Action for Chinese Application No. 201680050724.4, dated May 23, 2019.

* cited by examiner

SUPPORTING BEAM FOR SLAB SYSTEMS, SLAB SYSTEM AND METHOD FOR THE PRODUCTION THEREOF

CROSS REFERENCE TO RELATED APPLICATIONS

This application is a 371 national stage filing of International Application No. PCT/EP2016/070498, filed Aug. 31, 2016, which claims priority to German Patent Application No. DE 20 2015 104 628.6, filed Sep. 1, 2015, the entire contents of which are incorporated herein by reference.

TECHNICAL FIELD

The invention relates to a supporting beam for slab systems according to the preamble of claim 1. Such supporting beams are frequently used in steel-reinforced concrete construction and composite construction, particularly when building slab systems and storey slab.

PRIOR ART

For example, EP 1 611 295 B1 discloses a supporting beam of the same category. It comprises a hollow box cross-section and serves as a bearing for plate-shaped semi-finished parts or finished parts. After laying the semi-finished parts or finished parts, a local or large-scale in-situ concrete layer is applied which also penetrates into the inner of the hollow box cross-section of the supporting beam in order to produce the slab composite system. With this supporting beam consisting as such only of steel, such as with supporting beams consisting only of steel, in-situ concrete is introduced into the space of the supporting beam the slab plates are connected at the construction site, which space is defined by the webs, a base plate, and an upper plate (upper chord) opposite to the base plate (lower chord).

Such supporting beams known from the prior art have been proven successful. However, when connecting such supporting beams with the finished part or semi-finished part, bubbles in the concrete often occur below the upper plate and the concrete as a whole has to be introduced to the construction site using a relatively large amount of effort. Also, the full carrying capacity of the supporting beam is only given after the introduction of the in-situ concrete. Moreover, steel is under stress in the upper chord area, which causes technical disadvantages.

DESCRIPTION OF THE INVENTION

It is therefore the object of the present invention, with simple construction, to provide a supporting beam which enables a simple and reliable use in slab systems. At the same time, the weight of the supporting beam should be kept low.

This object is solved according to the invention by the supporting beam for composite slab systems having the features of claim 1. Accordingly, the supporting beam comprises a support, in particular a steel support, which comprises a base plate and at least one, preferably two webs which are arranged at an angle thereto, in particular perpendicular. The supporting beam is characterized in that a space limited by the web or webs and the base plate, preferably each of steel, is filled at least partially with concrete which in particular is not in-situ concrete, or the space between the web and the base plate or the webs and the base plate is filled at least partially with concrete which is in particular not in-situ concrete. Steel and concrete work together here in composite construction. In order to transmit forces as well to raise the composite effect, concrete-steel in stirrup shapes and as rods can be placed in the concrete.

Furthermore, according to the invention, the composite supporting beam is used in a composite slab system, with the supporting beam being used to support at least one semi-finished part or finished part and an in-situ concrete layer being provided in particular outside of the concrete which at least partially fills the space limited by the web or webs and the base plate or the space between the web or webs and the base plate, at least in the connecting area between the at least one supporting beam and the semi-finished part or finished part.

Furthermore, a composite slab system is provided according to the invention which comprises at least one supporting beam according to the invention, at least one semi-finished part or finished part which is supported on the at least one supporting beam, and an in-situ concrete layer which is provided at least in the connecting area between the at least one supporting beam and the semi-finished part or finished part, in particular outside of the concrete which at least partially fills the space between the web or webs and the base plate or the space limited by the web or webs and the base plate.

Also according to the invention, a method for producing a composite slab system is provided, namely having the steps of supporting at least a supporting beam according to the invention on bearings, supporting at a least semi-finished part or finished part on the at least one supporting beam, providing composite elements in the connecting area between the at least one supporting beam and semi-finished part or finished part, providing an in-situ concrete layer at least in the connecting area between the at least one supporting beam and the semi-finished part or finished part, in particular outside of the concrete which at least partially fills the space between the web or the webs and the base plate.

It is also conceivable here that the supporting beam in and for the composite construction manner is produced in several fabrication steps. For example, the introduction of reinforcement cages consisting of stirrups and steel rods and then later of concrete into the supporting beam can then occur at a later moment, so that there is firstly a semi-finished part which, in addition to the steel support, comprises connecting means, in particular a form-fit connecting means, for producing a form-fit connection with the concrete to be filled in.

Since the space limited by the web or webs and the base plate or the space between the web or webs and the base plate of the supporting beam is filled at least partially with concrete during installation, the supporting beam already comprises concrete before the connection with semi-finished parts or finished parts. In other words, the concrete is provided at least partially in this space before the connection with the finished part or semi-finished part, i.e. before the in-situ concrete layer is provided in the connecting area between the supporting beam and the semi-finished part or finished part. The supporting beam as such therefore already comprises, before connection with the finished part or semi-finished part, in the space limited by the web or webs and the base plate or in the space between the web or the webs and the base plate at least partially concrete which is not in-situ concrete. In a preferred embodiment, this space, except for the through-passages, is completely filled around possible steel reinforcements with concrete which is not in-situ concrete.

Since the composite supporting beam according to the invention already comprises concrete during the assembly, i.e. before connection with the slab system by in-situ concrete, it can already reliably carry the load of the slab or the finished part or semi-finished part during the assembly, namely across its entire length, without the need for intermediate supports or auxiliary supports to be used. The production of the slab system is simplified thereby and in particular follow-up work or parallel work can be performed more easily and more quickly. In particular, a stress zone is already present in the delivery state; even in order to place slab elements no additional support is required then since the stress zone is already (preferably entirely) formed by the concrete with or without reinforcement.

The construction height of the supporting beam corresponds to the height of the slab system plus the thickness of the base plate. Consequently, the construction height of the slab system can be minimized which leads to a reduction of the construction volume without having to simultaneously reduce the usable area. It is also conceivable in particular cases to connect in a force-fit the slab beam and the laterally placed slab elements as a slab disk by an in-situ concrete layer which is poured thereover with the help of reinforcement that placed thereover. In this case, the slab height is then higher above the slab beam by the height of the in-situ concrete layer.

Since concrete is already also used in the supporting beam in addition to steel, the arrangement of steel and concrete in the supporting beam can be optimized with regard to the requirements for compressive strength. This is the case, since the space limited by the web or webs and the base plate or the space between the web or webs and the base plate is filled at least partially with concrete which is preferably not in-situ concrete, is the stress zone of the beam for the live loading condition. The use of concrete instead of a steel chord reduces the weight of the supporting beam.

The present invention is based on the idea of using a supporting beam in slab systems, with the supporting beam as a composite construction component already comprising concrete before the connection with the slab system. Since the supporting beam as a pre-fabricated composite part as such not only comprises steel, but rather already concrete, it can also be regarded as a "hybrid beam". As a so-called steel-concrete composite beam (or "composite beam") the tensile load owing to the steel part and the compressive load is largely absorbed by the concrete part. Strong forces can be absorbed by inserted compression reinforcement.

The base plate is particularly to be understood as the lower chord. The base plate and the web arranged at an angle thereto or the webs arranged at an angle thereto which protrude from the same side of the base plate define the space in which concrete is provided at least partially. The arrangement of the base plate and the web is preferably U-shaped in the cross-section perpendicular to the longitudinal direction of the supporting beam.

A possible form also provides a web centrally with the base plate being there below in a concrete beam. The space for producing the concrete beam is then defined here by a two-sided auxiliary boarding. Also more than two webs, i.e. for example a central web and two side webs can be carried out for lateral space limiting.

The base plate can be laterally stiffened by transverse rib webs and thus obtains more loading capacity. These rib webs are then to be adjusted with recesses or limitations, measurements with the slab elements to be placed so that these can regardless be placed on the base plate.

The concrete is an arbitrary concrete, preferably a high-strength concrete, for example SCC. In particular, a concrete of class C 60/75 having chemical plasticizers as an additive or mixed with carbon fibers or glass fibers can be used. The concrete is preferably high-strength concrete (cylinder strength between 50 N/mm$^2$ and 100 N/mm$^2$ (C 100/115)). The concrete can be steel-reinforced concrete (preferably with concrete-steel stirrups and rods of highly reinforced steel-reinforced concrete). The concrete filling can therefore be carried out with or without reinforcement.

Additional connecting means are arranged between the concrete and the steel for the composite effect. These can be formed by the shaping of steel parts and/or by additionally attached connection bodies such as headed bolts, perforated sheet metal strips and/or structured parts, which transmit forces between concrete and steel.

Further advantageous developments are provided in the dependent claims.

It is preferred that the space filled at least partially with the concrete is at least in some areas, preferably entirely, open on the side facing away from the base plate. In other words, the support is preferably free of an upper steel plate extending parallel to a base plate, i.e. an upper chord of steel which limits the space between the webs and the base plate so that the space without the opposite plate is designated as open. The steel upper chord can therefore be dispensed with.

This embodiment has the advantage over the use of an additional upper plate, i.e. of a steel upper chord, in that the use of less steel reduces the weight of the supporting beam. Moreover, the use of concrete in this stress field is advantageous since steel is less pressure-stable than concrete. Consequently, in this embodiment, there is no plate, i.e. no upper chord, of steel in the stress field, but rather the more pressure-stable concrete.

Also, since the space to be filled with concrete is open at least in some areas, preferably entirely, on the side facing away from the base plate, the concrete can be more easily filled, namely directly from above instead of laterally through the webs. This results in no bubbles forming in the concrete, by which the production of such a supporting beam becomes easier and more reliable.

Moreover, it is possible to more easily use additional reinforcements extending parallel to the longitudinal direction of the supporting beam in the space between the webs such as reinforcing rods of steel—also bound into baskets with stirrups—since the space is at least in areas or entirely open from above and is thereby accessible.

Further preferably, the concrete protrudes over at least one web by a protrusion, with the protrusion preferably extending in a direction perpendicular to the base plate. The protrusion is preferably dimensioned such that the protrusion is flush with the slab plate. It is then not necessary to provide a top concrete layer. The protrusion can be a steel-reinforced concrete body.

Further preferably is that the protrusion has a toothing, in particular a longitudinal groove. This toothing can absorb the horizontal perpendicular forces. The toothing also serves to form an overall load-bearing effect between the supporting beam and the slab elements placed as stiff slab panes. In particular cases, the application of additional in-situ concrete layers is possible to achieve a greater slab stiffness.

One embodiment can comprise a stirrup basket. Reinforcement steel, preferably in the form of longitudinal rods, can be arranged therein. The stirrup basket and the reinforcement steel can be surrounded by concrete at least partially, preferably entirely. This arrangement of reinforcement interacting with the surrounding concrete constitutes steel-reinforced concrete which fills at least partially the space limited by the web or webs and the base plate.

The connecting means can extend through gaps in the stirrup basket in the direction transversely to the longitudinal direction L, i.e. in the transverse direction. The composite effect can be reinforced thereby.

Preferably, the inner surfaces of the web or webs, i.e. the surfaces which internally define the space between the webs, and/or the base plate, i.e. the side of the base plate which internally defines the space between the webs and the base plate, comprise connecting means. This can also mean that the web or the webs and/or the base plate itself is formed such that they can function as a connecting means. Connecting means can also be arranged integrally or additionally on the inner surface of the web or the webs and/or the base plate. Connecting means improve the connection between the support and the concrete.

Further preferably, the connecting means comprises form-fit connecting means, in particular headed bolts. These can particularly extend angularly from the webs in the space, further preferably substantially parallel to the base plate and perpendicular to the webs arranged perpendicular to the webs. Alternatively or additionally, connecting bolts extending from the base plate preferably parallel to the webs can be provided and/or plural connecting bolts which extend from one web preferably perpendicular to the base plate and are variable in their distance relative to the base plate, preferably displaceable along the web.

Generally, connecting means for the formation of a form-fit can be realized arbitrarily, as long as they, and thus the webs and/or the base plate, are formed to absorb and transmit composite transverse forces. For example, they could be depressions and/or projections which enable an interlinking between the webs or the base plate and the concrete. Particularly conceivable is a wave-shaped form on the inner side of the webs or base plate, for example, in that correspondingly wave-shaped plates or plate strips having a force-transmitting effect and are perforated, twisted or differently structured across the longitudinal direction are internally arranged as the connecting means and welded to the webs or the base plate. A further possibility is a strip having recesses.

These embodiments of connecting means as strips or bands have the further advantage over individual headed bolts in that they can be attached continuously or strip-shaped to the web or the base plate over the entire desired length, i.e. it is not necessary to individually attach or weld plural individual connecting means to the webs or the base plate.

This has economic advantages in particular over individually welded connecting bolts and the force transmission is not restricted to individual points, but rather is distributed which raises the usability.

It is particularly advantageous if through a corresponding shaping, for example, waves, folds, impressions or other shapes, of the supporting beam itself together with the concrete transmit forces particularly in the longitudinal direction between concrete and steel parts. This applies in equal measure for the concrete in the supporting beam as well as for a possible poured concrete or top concrete layer between or on the place slab elements. The supporting beam can for this also be higher than the placed slab elements.

In a particular embodiment, the webs on the upper side are carried out waved or folded by an upstream local shaping process. Not only does this help to transmit the composite forces between the concrete and the steel, but rather also enables the side webs to bend or bulge into themselves before the welding to the base plate in order to produce a curved supporting beam. Therefore a simpler producibility has a higher economic and technical significance.

The supporting beam can preferably have a camber which preferably corresponds to a later deflection. These supporting beams produced with so-called cambers have advantages for the perceivable small deflection in the finished construction since the deflection during placement of the slab elements and the camber practically cancel one another out. In the case whether with deformed upper web elements or level web elements, this is more easily produced with a supporting beam without a steel upper chord than with an upper chord since fewer parts need to be held and welded.

An arrangement of plural strips or plates in a horizontal or vertical direction, next to one another, for example parallel and/or at different depths of waves or projections and depressions can be designed arbitrarily.

Moreover, the supporting beam can comprise through-passages which extend transversely to the longitudinal axis of the supporting beam through the webs and preferably also through the space provided in the concrete. These mostly periodically repeating through-passages serve to accommodate composite elements which are provided in the connecting area between the supporting beam and the semi-finished part or finished part. The shear forces in the slab system can by this be reliably absorbed.

The inclusion or sliding through of reinforcing steel is also possible. This can serve to achieve a stiffening slab disk effect. This can occur depending on the height arrangement of the perforations by protruding reinforcement steels in the slab elements or reinforcement placed over that.

Preferably, the connecting means or bolts have at least the same distance to the base plate as the through-passages. A larger distance of the connecting means or form-fit connecting means to the base plate than to the protrusion is conceivable. This is advantageous in case of fire.

The in-situ concrete layer of the slab system is therefore provided preferably laterally from the webs around the toothing and through the through-passages in the supporting beam and preferably at least partially there above. In particular the area of the through-passages of the supporting beam as well as the upper area are to be understood as among the connecting area between the supporting beam and the semi-finished part or finished part.

Additionally, the base plate can comprise at least one projection which protrudes transversely to the longitudinal axis of the supporting beam across at least one web, with preferably an elastic damping element being provided on the at least one projection. Further preferably, they are provided on both side of the webs which are on the outside of the space which is defined by both of the webs. It is therefore intended that the webs are arranged offset inwardly from the edges of the base plate so that the areas of the base plate outside of the webs serve as projections.

A finished part or semi-finished part, in particular a slab plate, can be supported on the projection or the projections. If an elastic damping element is additionally provided, the support is optimized. The damping element can be, for example, an elastomer in a thickness of 3-5 mm, a width of preferably more than 30 mm which has a carrying capacity of up to 15 $N/mm^2$. The damping element can be continuously and/or linearly formed; it can also be formed selectively.

In order to improve the suitability for use under fire loads, the base plate or the support can have a fire-resistant layer. It is preferably applied at least partially in the space between the webs—i.e. in the supporting beam—on the base plate, with this layer being arranged in the space between the webs before the concrete is provided. Particularly effectively, alternatively or additionally, a fire-resistant layer can also be applied outside, i.e. on the side of the base plate facing away from the webs or on the underside of the base plate, at least partially along the base plate. The fire-resistant layer can be, for example, a fire-resistant construction plate PROMATECT® or a foaming agent. The fire-resistant layer can be a coating or can comprise one such.

Therefore, the steel base plate absorbing the tensile force of the bending beam is particularly effectively protected against overheating and premature failure when exposed to flames from beneath. The selective arrangement of the expensive fire prevention measures is only cost-effective in the area of the greatest effect.

Further features and advantages of the invention will become more evident by means of the detailed description below.

DETAILED DESCRIPTION OF PREFERRED EMBODIMENTS

Preferred embodiments of the present invention will be described in detail below with reference to the accompanying drawings.

Figure 1:
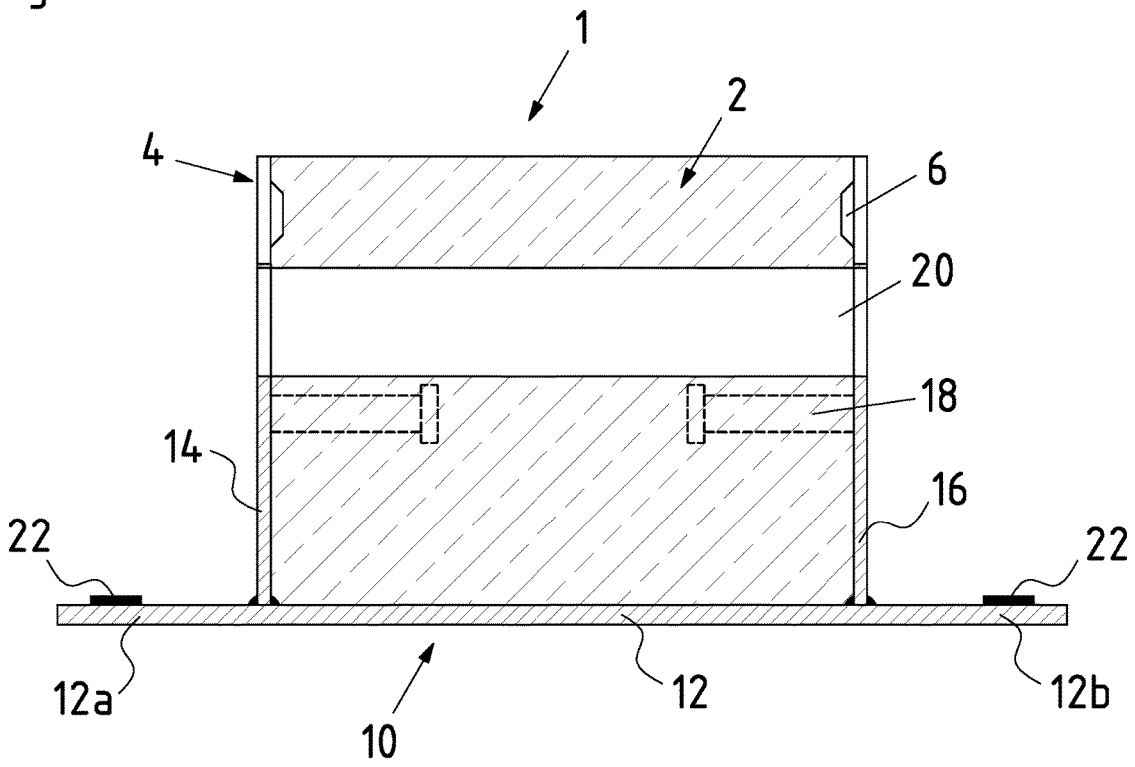
FIG. 1 shows a composite supporting beam according to the invention in a cross-section view perpendicular to the longitudinal direction of the supporting beam; the concrete filling can be carried out with or without reinforcement.

FIG. 1 shows a supporting beam 1 having a support 10 which consists of steel, and a base plate 12 as well as two webs 14 and 16 arranged perpendicular to the base plate 12. Both webs 14 and 16 extend to the same side of the base plate 12 substantially parallel to one another and perpendicular to the base plate 12, i.e. U-shaped.

Both webs 14, 16 and the base plate 12 define a space which is filled with concrete 2. The side, at which the space limited by the webs 14, 16 and the base plate 12 is open is opposite to the base plate. Over this side facing away from the base plate 12, a protrusion 4 protrudes over the space defined by the webs 14, 16 and the base plate 12. This protrusion 4 extends perpendicular to the base plate 12 and within an imagined continuation of the webs 14, 16, i.e. parallel to these.

On the sides transversely to the longitudinal direction L of the supporting beam, the protrusion 4 comprises a toothing 6. In the cross-section view of FIG. 1, this toothing is depicted as a groove on the left and right in the protrusion 4.

Figure 6:
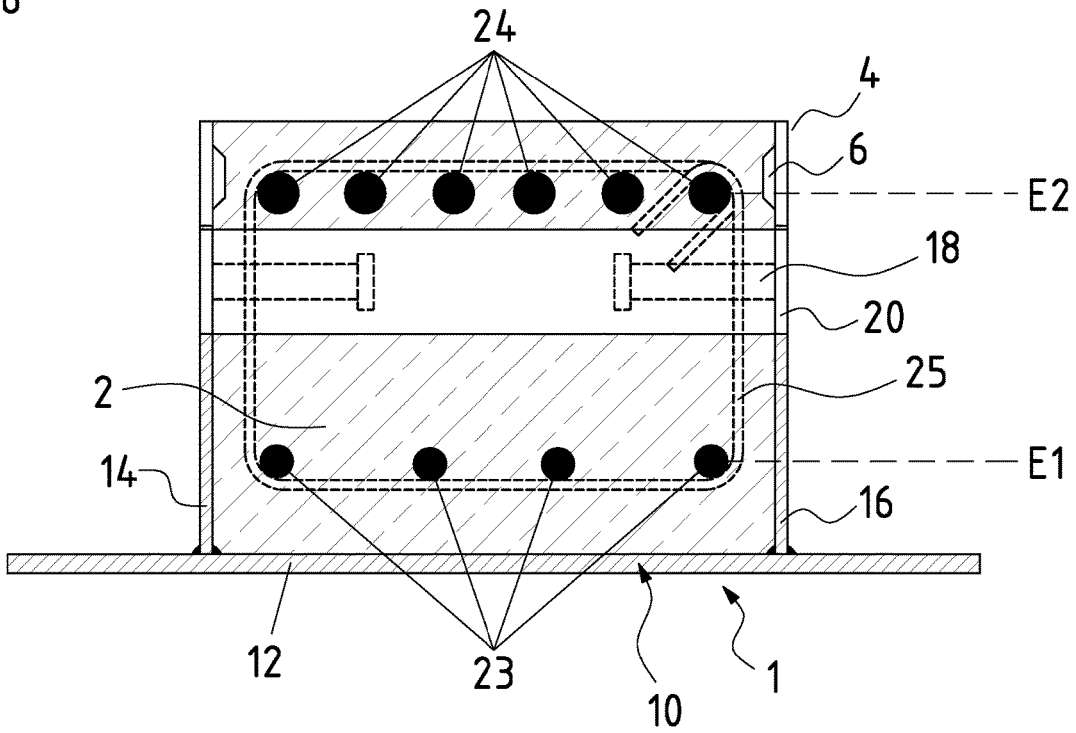
FIG. 6 shows a supporting beam according to the invention in a cross-section view perpendicular to the longitudinal direction of the supporting beam.

Moreover, on the inner surface of the webs 14, 16, i.e. the surface which defines the space between the webs, a connecting means 18 is provided which is formed as a headed bolt and serves the form-fitting connection with the concrete 2. The headed bolt 18 extends from the webs 14, 16 perpendicular and parallel to the base plate 12 at in each case approximately one quarter of the expansion of the space between the webs along the transverse direction of the supporting beam 12 in the concrete 2. In FIG. 1, the connecting means or bolts 18 have a smaller distance to the base plate 12 than the through-passages 20. Preferably, the connecting means or bolts 18 are, however, at least the same distance to the base plate as the through-passages 20. They can have the same distance to the base plate as the through-passages 20, as shown in FIG. 6. However, a larger distance to the base plate 20 is conceivable. This is advantageous in case of fire.

The transverse direction extends perpendicular to the longitudinal direction L of the supporting beam 1 and therefore from right to left in FIG. 1.

An alternative or additional arrangement of bolts which is not shown is that the bolts 18 extend from the base plate 12 parallel to the webs 14, 16 and/or plural bolts extend from one web 14, 16 parallel to the base plate 12 and preferably here the distance of the bolts 18 relative to the base plate 12 or to one another is variable, in particular the bolts at the web 14, 16 are displaceably arranged so that the bolts 18 can be arranged, for example, changing centrally or above in the supporting beam 1.

Figure 2:
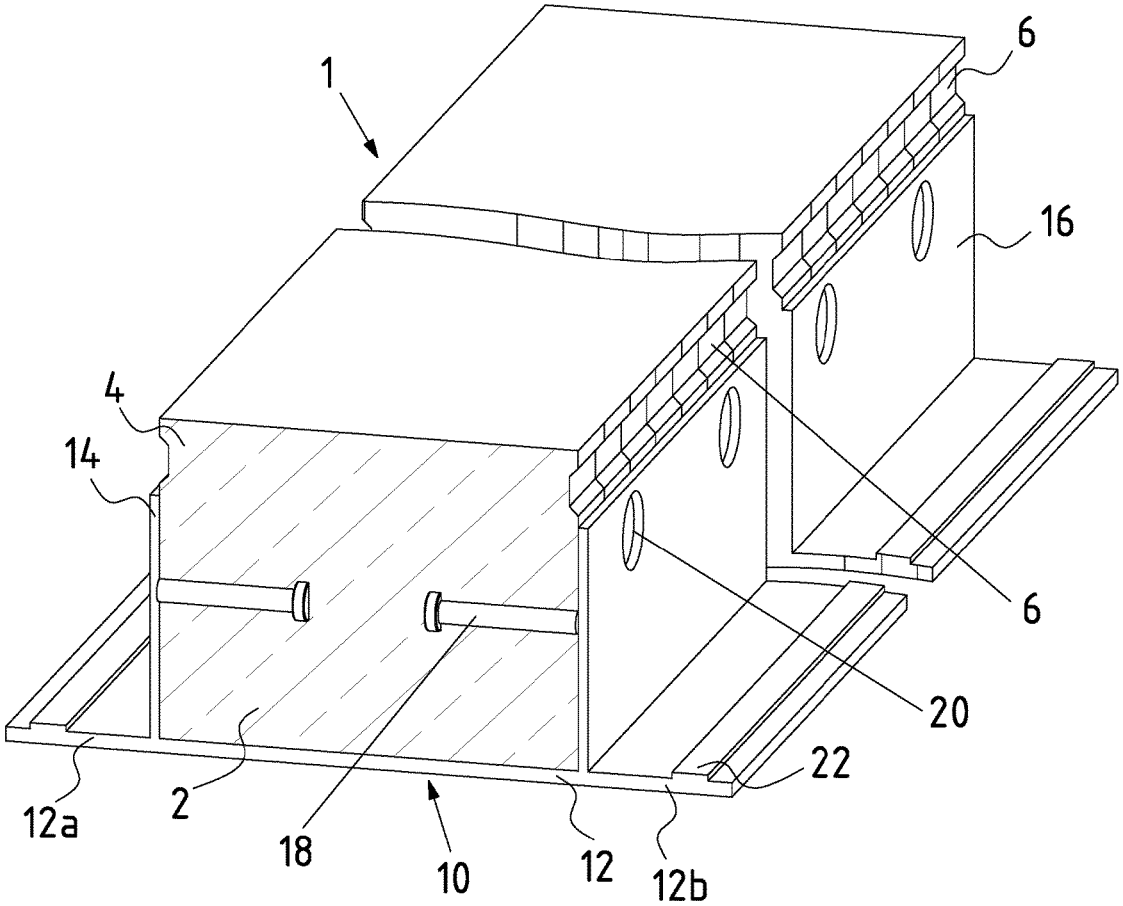
FIG. 2*a* shows a perspective view of the supporting beam according to the invention having a concrete or steel-reinforced concrete filling.
FIG. 2*b* shows a further embodiment of the supporting beam according to the invention.
Figure 2:
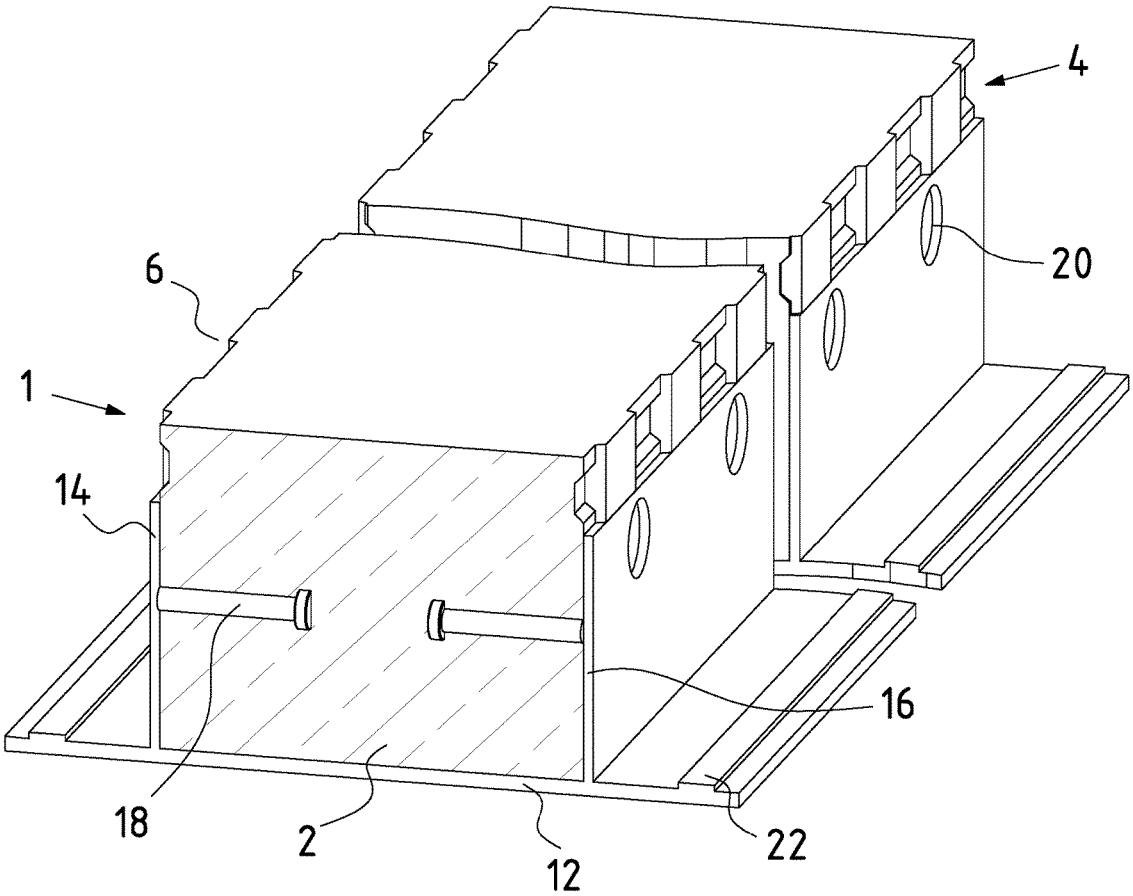

Unlike as shown in FIG. 2, the webs 16 and 14 can be carried out in a waved/folded/shaped manner in order to thus, with a force-transmitting form-fit, also take on the effect of the connecting means 18, and these can then be entirely or partially dispensed with or also supplemented by continuous elements.

Through-passages 20 extend transversely to the longitudinal axis L of the supporting beam 1, i.e. in the transverse direction, through the webs 14, 16 and through the concrete 2 which is filled between the webs.

Figure 3:
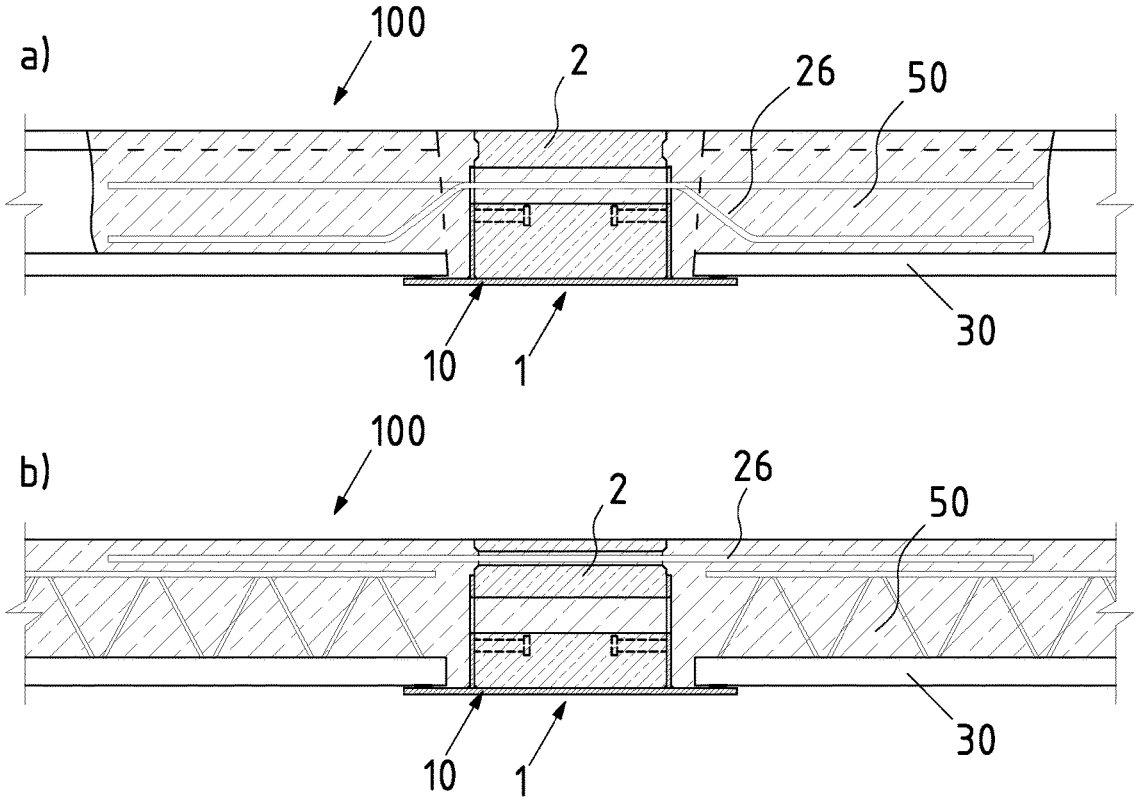
FIG. 3 shows slab systems according to the invention, with FIG. 3*a* showing the connection of a supporting beam according to the invention with a hollow box place and FIG. 3*b* showing the connection of a supporting beam according to the invention having a compound slab consisting of element slab as a semi-finished part having lattice support reinforcement and top concrete.
Figure 4:
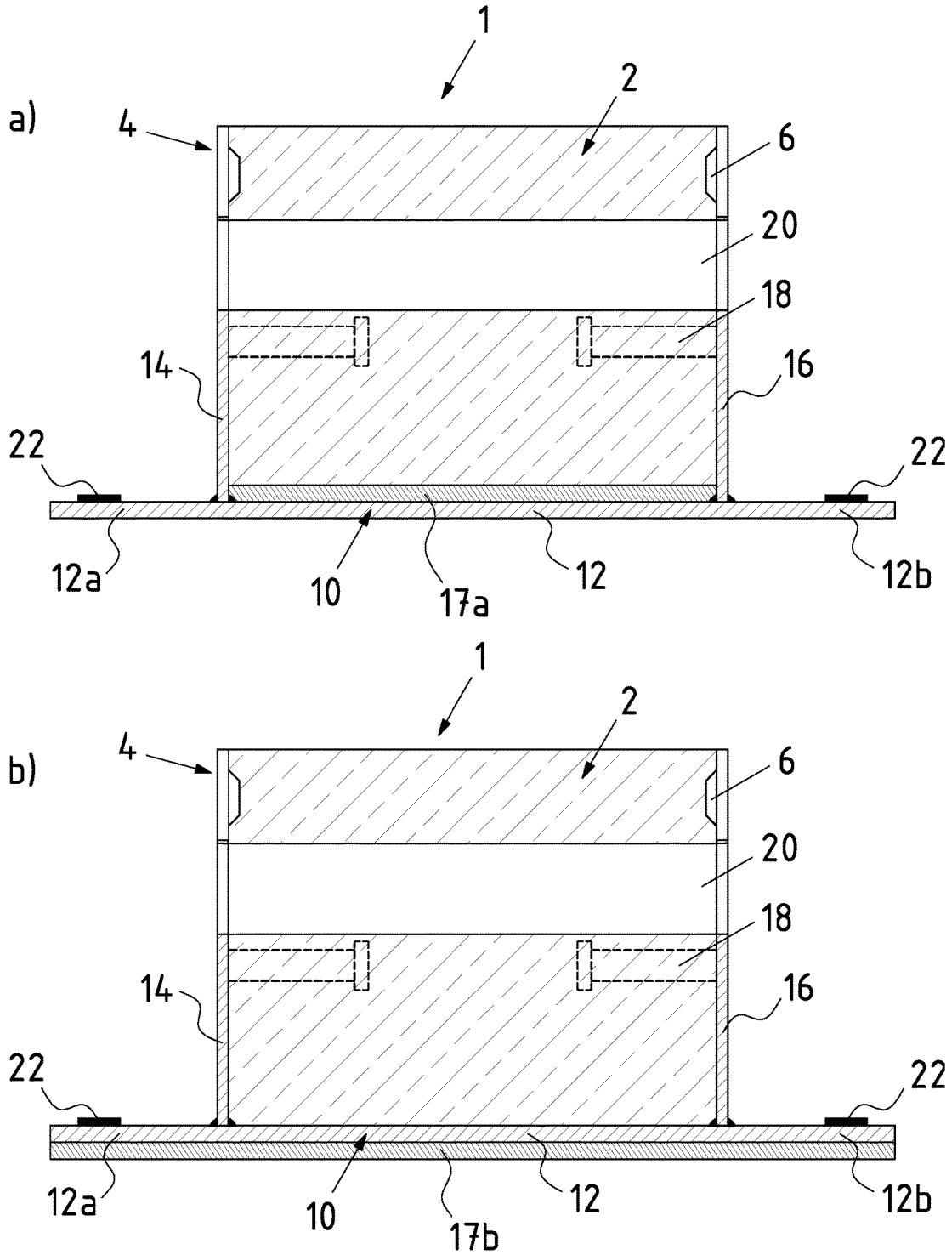
FIGS. 4*a* and 4*b* show a supporting beam according to the invention in a cross-section view perpendicular to the longitudinal direction of the supporting beam having a fire-resistant layer.

Unlike as shown in FIGS. 2 and 4, as indicated in FIG. 3*b*, the perforations or through-passages in the expanded concrete piece can also be arranged further up so that in the case of assembly they are located above the slab elements placed on the supporting beam 1 and the serve the accommodation of pushed-through reinforcement to form e.g. a slab disk with in-situ concrete.

The base plate comprises two projections 12*a*, 12*b* which extend transversely to the longitudinal axis of the supporting beam, i.e. in the transverse direction. These projections correspond to the peripheral areas of the base plate 12 in the transverse direction of the supporting beam 1.

On both projections 12*a*, 12*b*, an elastic damping element 22 is each provided on the side of the base plate 12 which points towards the webs 14, 16. The semi-finished part or finished part is placed on these damping elements 22. The elastic damping element 22 can be continuously formed in the longitudinal direction L. It centers the load.

FIG. 2*a* shows a perspective view of the supporting beam 1. It is apparent from this that the elastic damping elements 22 are on the projections 12*a*, 12*b* substantially continuously along the longitudinal direction L.

Moreover, it is apparent that the toothing 6 is formed, by way of example here, as a periodic longitudinal groove. Other embodiments can also provide the toothing outside of the longitudinal groove. Moreover, the through-passages 20 that are arranged at equal distances along the longitudinal direction are shown, through one of which the cross-section of FIG. 1 is taken.

FIG. 2*b* shows a different embodiment of the supporting beam 1 having the protrusion 4 of concrete or steel-reinforced concrete and the connecting means that are distinct there in the form of a toothing 6. These can be formed with or without the longitudinal groove.

FIGS. 4*a* and 4*b* show an embodiment having a fire-resistant layer 17*a*, 17*b*. FIG. 4*a* shows an embodiment in which a fire-resistant layer 17*a* is provided on the base plate 12, in particular in the supporting beam 1 between the webs 14, 16. In FIG. 4*b*, a fire-resistant layer 17*b* is arranged beneath the support 10 or the base plate 12, i.e. at the side of the support 10 or the base plate 12 facing away from the webs 14, 16. The fire-resistant layer 17*b* can also carry a coating or be a coating itself.

Figure 5:
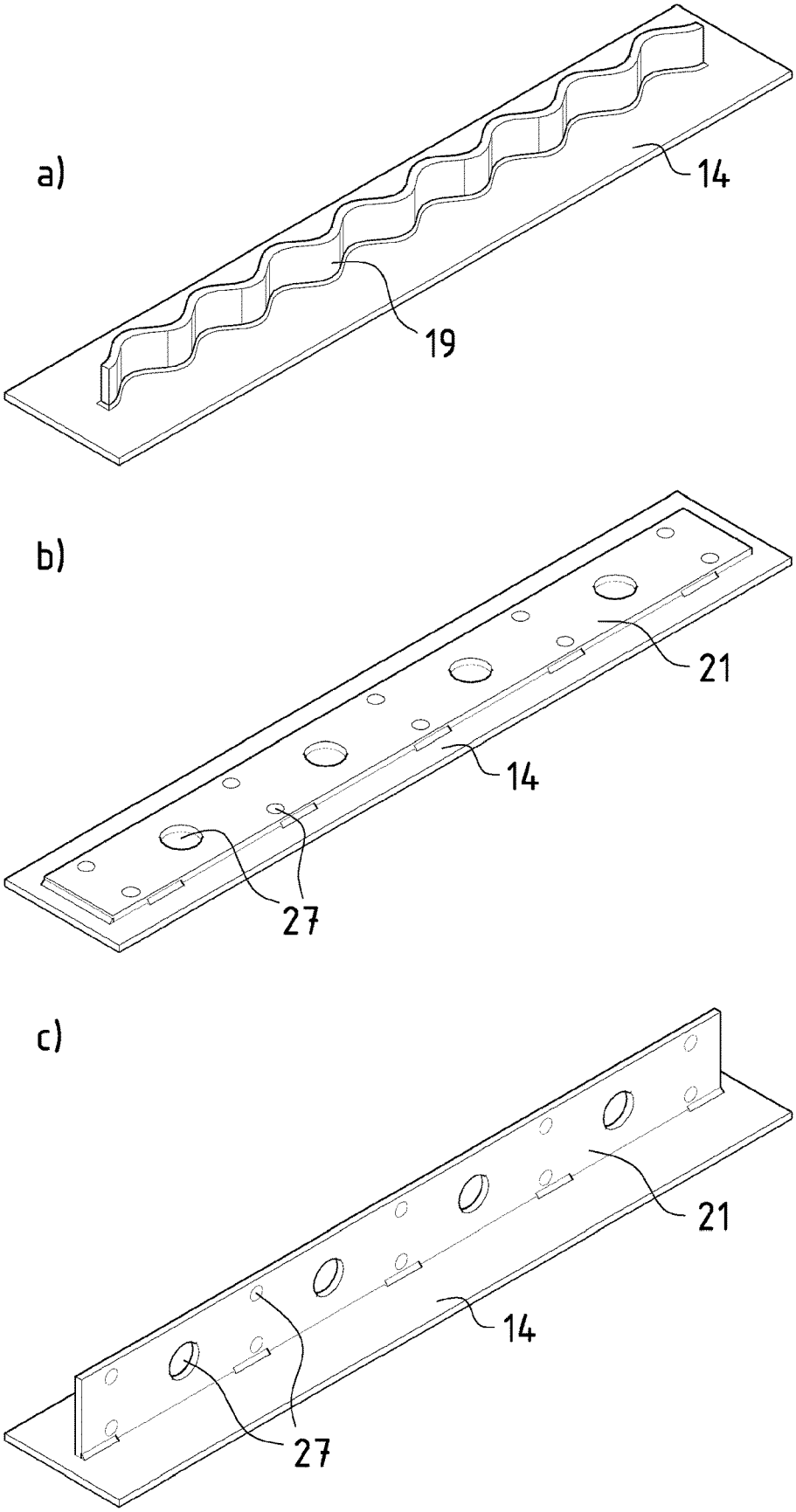
FIGS. 5*a*, 5*b* and 5*c* show further embodiments of connecting means according to the present invention.
FIG. 5*d* shows an embodiment of the steel part of the supporting beam having a toothing of the webs through folding or bending as the linearly arranged connecting means as they are shown in other embodiments in FIGS. 5*a*, *b* and *c*.
Figure 5:
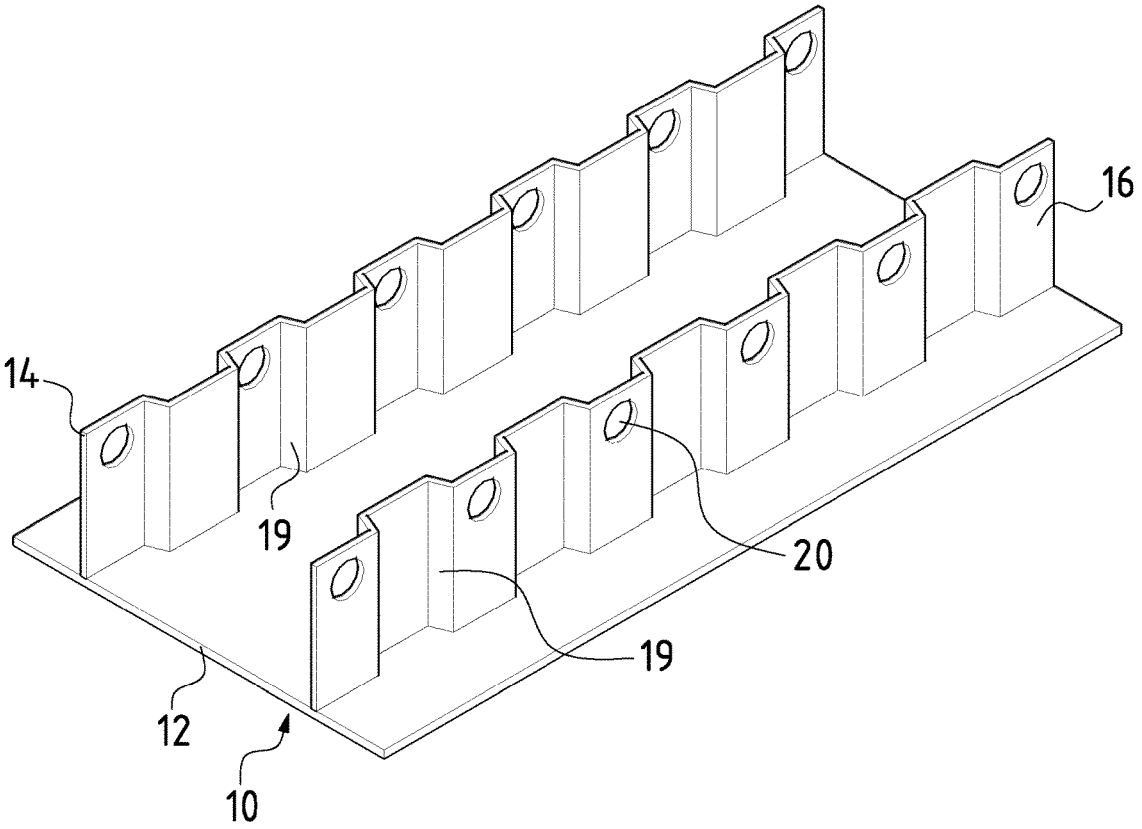

FIG. 5*a* shows a further embodiment for connecting means according to the invention for achieving a form-fit, namely waved plates 19. These waved plates are also representative for other deformed strip plates which can transmit composite forces through projections/recesses/surface contours. For example, these could be twisted, folded or plastically deformed areas on the metal strip.

These can be attached to the inner surface of the webs 14, 16 and/or the base plate 12 such that the waves and therefore the webs or the base plate can absorb composite forces between concrete and steel.

FIG. 5*b* shows an embodiment in which the connecting means according to the invention is realized by a strip or a perforated plate 21 which comprises recesses 27 for absorbing transverse forces. The perforated plate 21 extends here parallel to web 14 and/or 16.

FIG. 5*c* shows a perforated plate 21 having recesses 27, which is arranged perpendicular to the web 14 and/or 16.

FIG. 5*d* shows a further variant of the steel part of the supporting beam in which the side-web embodiment 19 formed as a fold/bend is arranged together with the base plate 12. In other words, the web 14 and/or 16 therefore comprises folds and/or bends.

FIG. 3 shows one slab system 100 according to the invention having the supporting beam 1 according to the invention as well as a semi-finished part 30 which is supported on the supporting beam 1. Composite elements 26, in particular reinforcing steel, were guided through the through-passage 20 into the supporting beam. The connecting area between the supporting beam 1 and the semi-finished part 30 is filled with in-situ concrete 50. It is particularly evident from FIG. 3*a* that the in-situ concrete 50 does not penetrate into the through-passages 20 of the supporting beam 1, but rather, the supporting beam 1 is only filled with the concrete 2.

During production of the slab system 100, the supporting beam 1 is firstly supported on bearings (not shown), the semi-finished part 30 is subsequently supported on the supporting beam 1, in particular the projections 12*a*, 12*b*. Afterwards, the composite elements 26 are introduced into the through-passages 20 of the supporting beam and thus a connecting area between the supporting beam 1 and the semi-finished part 30 is produced. Lastly, the in-situ concrete layer 50 is applied in the connecting area between the supporting beam and the semi-finished part 30. The in-situ concrete 50 here only penetrates into the through-passages 20 of the supporting beam 1. The space between the webs is not filled with in-situ concrete 50, but rather, has already been filled with concrete 2 during the manufacture of the supporting beam.

FIG. 6 shows an embodiment which has a stirrup basket 25. The reinforcement steel is arranged therein in the form of longitudinal rods 23, 24 which extend in the longitudinal direction L. The stirrup basket 25 and the reinforcement steel 23, 24 are surrounded by concrete 2.

The connecting means 18 extend through gaps in the stirrup basket 25, as is apparent from FIG. 6. The composite effect can be reinforced thereby. In other words, the connecting means 18 can therefore be anchored into the concrete 2 even better.

In this preferred embodiment, the connecting means 18 and the through-passages 20 are arranged at the same distance to the base plate 12. Also in this embodiment as shown, for example, in FIGS. 2*a* and 2*b* for the embodiment of FIG. 1, the connecting means 18 and the through-passages 20 are arranged offset to one another in the longitudinal direction L. Moreover, in the embodiment of FIG. 6, damping elements 22 can also be arranged on the projections 12*a*, 12*b* substantially continuously along the longitudinal direction L. Other arrangements of the damping elements 22 are possible as well, in particular such as described above.

The reinforcing rods 23, 24 extending in the longitudinal direction L are preferably arranged on two levels, namely the reinforcing rods 23 on a level E1 which is arranged on the (lower) side of the stirrup basket 25 toward the base plate 12, and the reinforcing rods 24 on a level E2 which is arranged on the opposite (upper) side of the stirrup basket 25, namely on the side towards the protrusion 4. Preferably, there a six reinforcing rods 24 arranged in the level E2 and four reinforcing rods 23 in the level E1, which extend in the longitudinal direction L. Any other number is possible depending on strength requirement. The upper level E2 of the reinforcement steels 24 with the concrete 2 forms a reinforced compression chord of the connecting beam.

The invention claimed is:

1. A supporting beam for composite slab systems which is formed at least partially of concrete, the supporting beam comprising:

a support which includes a base plate and one or more webs which are arranged at an angle thereto, wherein:

a space limited by the one or more webs and the base plate is filled at least partially with precast concrete, the supporting beam has through-passages which extend transversely to the longitudinal axis of the supporting beam through the one or more webs and the precast concrete, the through-passages being open and configured to receive composite elements therethrough, the supporting beam comprises a stirrup basket, the base plate includes at least one projection which protrudes transversely to the longitudinal axis of the supporting beam across at least one web, and the space filled with the precast concrete is open on a side of the support facing away from the base plate along at least some areas of the support.

2. The supporting beam according to claim 1, wherein the precast concrete protrudes above at least one web in a direction away from the base plate to form a protrusion.

3. The supporting beam according to claim 2, wherein the protrusion includes a toothing.

4. The supporting beam according to claim 3, wherein the toothing includes at least one longitudinal groove.

5. The supporting beam according to claim 2, wherein the protrusion extends in a direction perpendicular to the base plate.

6. The supporting beam according to claim 1, wherein the inner surface of the one or more webs and/or the base plate includes at least one connector to couple the precast concrete to the support.

7. The supporting beam according to claim 6, wherein the connector includes a form-fit connector.

8. The supporting beam according to claim 7, wherein the stirrup basket includes reinforcement steel.

9. The supporting beam according to claim 8, wherein the precast concrete at least partially surrounds the stirrup basket and the reinforcement steel.

10. The supporting beam according to claim 8, wherein the at least one connector extends through gaps in the stirrup basket in a direction perpendicular to the longitudinal direction.

11. The supporting beam according to claim 8, wherein the reinforcement steel includes longitudinal rods.

12. The supporting beam according to claim 8, wherein the precast concrete entirely surrounds the stirrup basket and the reinforcement steel.

13. The supporting beam according to claim 7, wherein the form-fit connector includes depressions, projections, headed bolts and/or recesses, and/or has wave-shaped, folded and/or bent configurations.

14. The supporting beam according to claim 6, wherein the one or more webs and/or the base plate are formed by projections, depressions, deformations and/or recesses to connect the precast concrete to the support.

15. The supporting beam according to claim 1, wherein the distance from the through-passages to the base plate and the distance from the form-fit connector to the base plate are substantially equal.

16. The supporting beam according to claim 1, further comprising an elastic damping element provided on the at least one projection.

17. The supporting beam according to claim 1, wherein the support includes a fire-resistant layer.

18. The supporting beam according to claim 1, wherein the supporting beam includes a camber.

19. A composite slab system, comprising:

at least one supporting beam according to claim 1, at least one semi-finished part or finished part which is supported on the at least one supporting beam, and an in-situ concrete layer which is provided at least in a connecting area between the at least one supporting beam and the semi-finished part or finished part.

20. A method for producing a composite slab system, the method comprising steps of:

supporting at least one supporting beam according to claim 1 on bearings, supporting at least one semi-finished part or finished part on the at least one supporting beam, providing composite elements in the connecting area between the at least one supporting beam and the at least one semi-finished part or finished part, providing an in-situ concrete layer at least in a connecting area between the at least one supporting beam and the semi-finished part or finished part.

21. The method according to claim 20, wherein a plurality of composite elements are each guided through a through-passage provided in the at least one supporting beam.

22. The supporting beam according to claim 1, wherein the one or more webs includes two webs.

23. The supporting beam according to claim 1, wherein the one or more webs are arranged perpendicular to the base plate.

24. The supporting beam according to claim 1, wherein the support is a steel support.

25. The supporting beam according to claim 1, wherein the space filled with the precast concrete is entirely open on the side of the support facing away from the base plate.

* * * * *